US011236737B2

(12) United States Patent
Indruk

(10) Patent No.: US 11,236,737 B2
(45) **Date of Patent: *Feb. 1, 2022**

(54) FOAM PUMP AND DISPENSER EMPLOYING SAME

(71) Applicant: Gregory L. Indruk, Nashua, NH (US)

(72) Inventor: Gregory L. Indruk, Nashua, NH (US)

( * ) Notice: Subject to any disclaimer, the term of this patent is extended or adjusted under 35 U.S.C. 154(b) by 199 days.

This patent is subject to a terminal disclaimer.

(21) Appl. No.: 16/437,703

(22) Filed: Jun. 11, 2019

(65) Prior Publication Data

US 2019/0293059 A1 Sep. 26, 2019

Related U.S. Application Data

(63) Continuation of application No. 15/099,918, filed on Apr. 15, 2016, now Pat. No. 10,359,031.

(Continued)

(51) Int. Cl.

| | |
|---|---|
| ***F04B 15/00*** | (2006.01) |
| ***F04B 9/14*** | (2006.01) |
| ***F04B 13/02*** | (2006.01) |
| ***F04B 19/06*** | (2006.01) |
| ***F04B 7/02*** | (2006.01) |
| ***F04B 9/02*** | (2006.01) |
| ***F04B 23/02*** | (2006.01) |
| ***F04B 53/12*** | (2006.01) |

(52) U.S. Cl.

CPC ..... *F04B 15/00* (2013.01); *F04B 7/0266* (2013.01); *F04B 9/14* (2013.01); *F04B 13/02* (2013.01); *F04B 19/06* (2013.01); *F04B 7/0275* (2013.01); *F04B 9/02* (2013.01); *F04B 23/028* (2013.01); *F04B 53/123* (2013.01)

(58) Field of Classification Search

CPC ..... F04B 7/0266; F04B 7/0275; F04B 9/02; F04B 9/14; F04B 13/02; F04B 15/00; F04B 19/06; F04B 23/028; F04B 53/123; B05B 7/005–0068; B05B 7/0018; B05B 7/3087

See application file for complete search history.

(56) References Cited

U.S. PATENT DOCUMENTS 5,255,851 A * 10/1993 Tobler ..... B05B 7/0037 222/190

5,271,530 A * 12/1993 Uehira ..... B05B 7/0037 222/190

(Continued)

*Primary Examiner* — Alexander B Comley

(74) *Attorney, Agent, or Firm* — McLane Middleton, Professional Association

(57) ABSTRACT

A foam pump has dual, coaxial air and liquid cylinders, each having a respective air and liquid piston which move together during a dispensing operation. One or more air passageways between the air cylinder and a liquid-air mixing chamber are configured to impart rotation to an airstream passing from the air cylinder to the mixing chamber to increase turbulent mixing of the air and liquid in the mixing chamber. The liquid cylinder is axially aligned with the air cylinder to provide a low profile pump which does not require a dip tube or sleeve to communicate with the bottom of the liquid source when used in an inverted application wherein the foam pump is positioned below the source of liquid. A resilient valve member in the liquid outlet is biased to close on its own to prevent leaking in the event the air and liquid pistons do not fully return to the home position.

34 Claims, 10 Drawing Sheets

Related U.S. Application Data

(60) Provisional application No. 62/160,057, filed on May 12, 2015.

(56) References Cited

U.S. PATENT DOCUMENTS 5,443,569 A * 8/1995 Uehira ..... B05B 7/0031 222/190
5,570,606 A 11/1996 Irie
6,053,364 A * 4/2000 van der Heijden ..... B05B 11/3087 222/145.6
6,082,586 A * 7/2000 Banks ..... B05B 11/3087 222/95
6,612,468 B2 * 9/2003 Pritchett ..... B05B 7/0037 222/190
7,641,077 B2 * 1/2010 Law ..... B05B 7/0025 222/190
7,661,561 B2 2/2010 Ophardt et al.
7,850,049 B2 12/2010 Ciavarella et al.
8,109,415 B2 * 2/2012 Tu ..... F04B 15/00 222/190
8,393,500 B2 3/2013 Mizushima et al.
8,418,889 B2 * 4/2013 Pritchett ..... B05B 11/3025 222/190
8,430,274 B2 * 4/2013 van der Heijden ..... B05B 11/3087 222/190
8,490,833 B2 7/2013 van der Heijden
8,499,981 B2 8/2013 Quinlan et al.
8,591,207 B2 11/2013 Ciavarella
9,004,319 B2 * 4/2015 Kim ..... B05B 11/3087 222/190
9,307,871 B2 * 4/2016 McNulty ..... B05B 11/3087
9,596,963 B2 * 3/2017 Harris ..... B05B 11/00442
9,642,502 B2 * 5/2017 Harris ..... A47K 5/1211
10,359,031 B2 * 7/2019 Indruk ..... F04B 9/14
2008/0083784 A1 * 4/2008 Foster ..... B05B 11/3059 222/153.13
2009/0294478 A1 * 12/2009 Ciavarella ..... B05B 7/0037 222/190
2014/0091106 A1 * 4/2014 Ophardt ..... F04B 23/028 222/181.3
2014/0367419 A1 * 12/2014 Harris ..... B05B 7/0025 222/190
2015/0291345 A1 * 10/2015 Ophardt ..... B05B 11/3087 222/401
2016/0256015 A1 * 9/2016 Ophardt ..... F04B 19/22
2016/0333874 A1 * 11/2016 Indruk ..... F04B 15/00
2019/0293059 A1 * 9/2019 Indruk ..... F04B 13/02

* cited by examiner

FOAM PUMP AND DISPENSER EMPLOYING SAME

CROSS REFERENCE TO RELATED APPLICATIONS

This application is a continuation of application Ser. No. 15/099,918 filed Apr. 15, 2016, which in turn claims the priority benefit of U.S. provisional application No. 62/160,057 filed May 12, 2015. Each of the aforementioned applications is incorporated herein by reference in its entirety.

BACKGROUND

The present invention relates to an apparatus for dispensing a foam comprising a mixture of a foamable liquid and air. Foam pumps are commonly used to dispense a foamable liquid from a rigid container. In such applications, a foam pump is typically mounted in the neck of a rigid container and employs a dip tube extending from a liquid inlet of the foam pump to the bottom of the container. A manually depressible nozzle is typically attached to the liquid outlet of the foam pump for dispensing the liquid-air mixture. Such foam pumps often employ an air cylinder and a liquid cylinder that are concentrically arranged but axially offset. The axial offset between the liquid cylinder and the air cylinder increases the axial length of the pump. An exemplary, commercially foam engine of this type is descried in U.S. Pat. No. 6,053,364, incorporated herein by reference in its entirety.

U.S. Pat. No. 8,336,740 discloses a system and method for adapting such prior art foam pumps for use in a bag-in-box type fluid dispenser. In a bag-in-box dispenser, the fluid reservoir is positioned above the pump and the pump is inverted such that the liquid outlet of the pump is positioned below the liquid inlet of the pump. However, because of the axial offset between the air cylinder and the liquid cylinder, such pumps generally have a high profile and extend into the bag containing the liquid to be dispensed. As such, with such pumps, measures must be taken to allow the liquid pump inlet to communicate with the bottom of the fluid reservoir to avoid product waste. The aforementioned U.S. Pat. No. 8,336,740 is incorporated herein by reference in its entirety.

In addition, such fluid reservoirs are typically plastic bags constructed from flexible plastic film, which are configured to allow the pressure within the bag to equalize with the ambient air pressure to avoid the need to vent the fluid reservoir. Such plastic bags are prone to puncture and the prior art high profile pumps extending into the flexible bags are a source of trauma to the bags during transport and handling.

Furthermore, leakage is of special concern for foam pumps that are employed in an inverted orientation. In such inverted applications, the fluid source is located above the pump. Thus, if the pump piston were to stick or liquid outlet valve were to otherwise fail, catastrophic leakage could occur resulting in not only product waste but also a potentially hazardous condition, e.g., should the liquid product leak onto the floor.

The present disclosure contemplates a new and improved foam pump and dispenser which overcome the above-referenced problems and others.

SUMMARY

In one aspect, a foam pump comprises a dual air and liquid cylinder including a base wall having a central opening therein defining a liquid inlet; an inner annular wall extending from the base wall and surrounding the central opening and having an open end opposite the base wall; and an outer annular wall extending from the base wall and surrounding the inner annular wall and having an open end opposite the base wall. A dual air and liquid piston assembly is received in the dual air and liquid cylinder, the dual air and liquid piston assembly including an air piston member including an air piston ring slidably engaging an inner surface of the outer annular wall, the air piston member cooperating with the outer annular wall to define a collapsible air chamber for receiving air; a liquid piston assembly including a liquid piston ring supported on a liquid piston shaft, the liquid piston ring slidably engaging an inner surface of the inner annular wall, the liquid piston cooperating with the inner annular wall to define a collapsible liquid chamber for receiving a foamable liquid; and the liquid piston shaft having a first end axially adjacent the collapsible liquid chamber, a second end defining a liquid outlet, and a central passageway extending between the first end and the second end, the second end of the liquid piston shaft attached to the air piston member to move therewith. A liquid inlet valve member is received within the central opening for regulating flow through the liquid inlet and a liquid outlet valve is received within the second end of the liquid piston shaft for regulating flow through the liquid outlet. The dual air and liquid piston assembly includes a mixing chamber downstream of the liquid outlet, the mixing chamber being in fluid communication with the collapsible liquid chamber through the liquid outlet valve. The mixing chamber is in fluid communication with the collapsible air chamber through a plurality of air passageways between the air piston member and the liquid piston shaft, wherein each of the air passageways is configured to impart a rotational flow to air entering the mixing chamber. A biasing member urges the piston assembly to a non-actuated position, wherein the foam pump is actuatable by urging the piston assembly against the biasing member to an actuated position in which the collapsible air chamber and the collapsible liquid chamber are reduced in volume such that air is expelled from the collapsible air chamber and through the plurality of channels into the mixing chamber while at the same time foamable liquid is expelled from the collapsible liquid chamber through the central passageway with simultaneous movement of the air and the foamable liquid into the mixing chamber causing a turbulent mixing thereof in the mixing chamber of the foam pump.

In another aspect, a foam pump assembly including the foam pump apparatus in accordance with this disclosure and a container containing a foamable liquid is provided.

In yet another aspect, a dispensing apparatus for dispensing a foamable liquid is provided.

One advantage of the present development resides in its improved foam generation due to its spiraling air outlet channels which induce a vortex at the mixing chamber and improve turbulent mixing of the air and foamable liquid.

Another advantage of the present development is found in its use of a liquid outlet valve which is biased to close on its own. In certain embodiments, the liquid outlet valve is formed of a resilient material, such as an elastomeric polymer material. In other embodiments, a check valve comprising a ball and spring may be employed. The foam pump in accordance with this disclosure is especially advantageous for use in inverted applications since it does not depend on the return of the pump piston to the non-actuated or home position to shut off flow through the liquid outlet.

The self-closing outlet valve of the present disclosure prevents leaking if the foam pump pistons do not return to the fully non-actuated position.

Another advantage of the present development resides in the location of the liquid piston substantially within the air chamber. This lowers the liquid inlet and eliminates the need for an additional component such as a dip tube or dip sleeve to communicate with the bottom of the bag containing the liquid. The lower profile achieved by eliminating or substantially reducing the axial offset between the air chamber and the liquid chamber also eliminates a potential source of bag punctures by reducing the degree to which the foam pump protrudes into the bag reservoir area. Potential fractures in the prior art devices, due to deflection stress, at the junction of the liquid chamber and the air chamber in the prior art foam pumps having an axial offset between the liquid chamber and the air chamber are also avoided in the low foam pumps according to this disclosure.

Still further advantages and benefits of the present invention will become apparent to those of ordinary skill in the art upon reading and understanding the following detailed description of the preferred embodiments.

BRIEF DESCRIPTION OF THE DRAWING

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
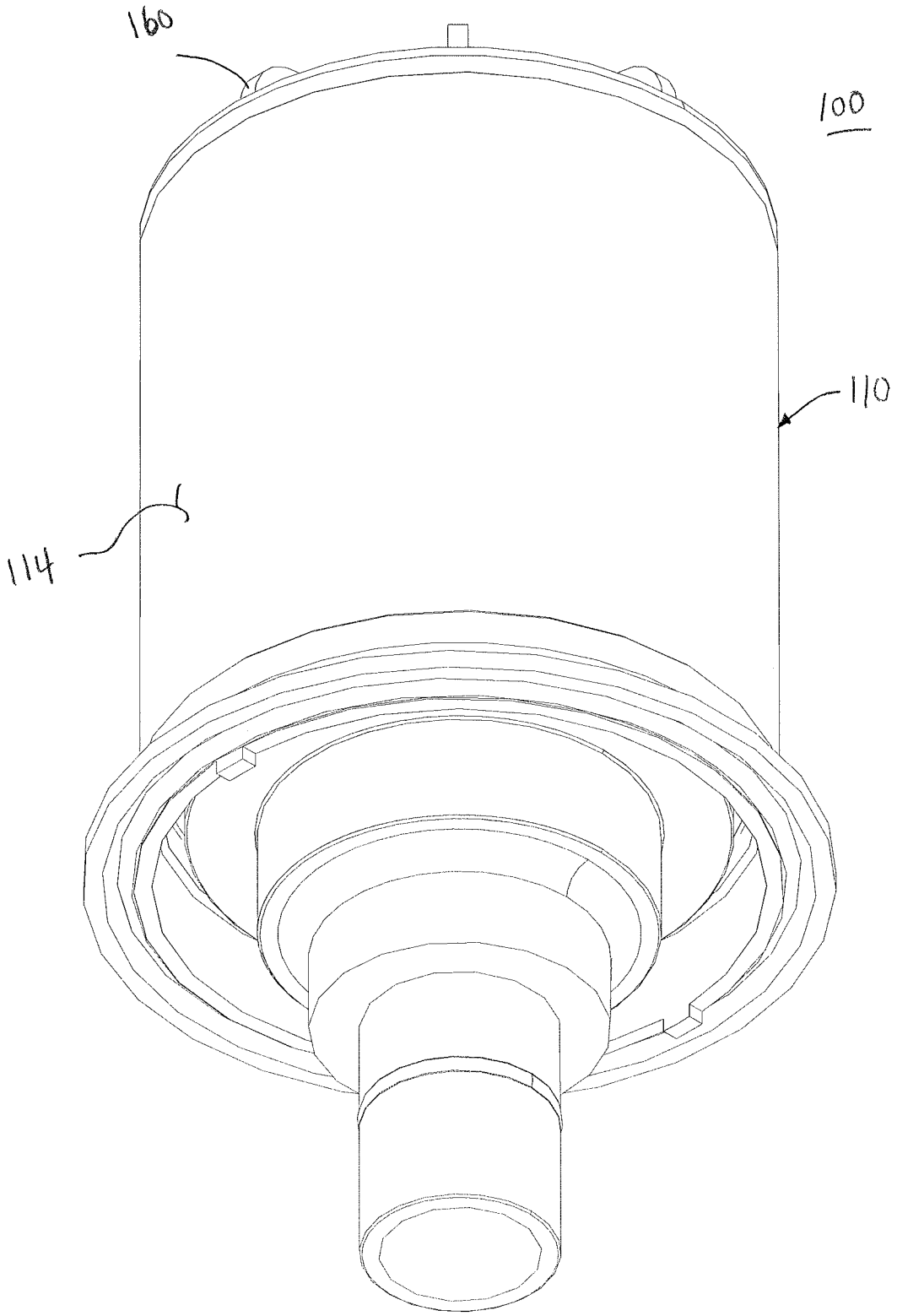
FIG. 1 is an isometric view of a foam pump in accordance with an exemplary embodiment of the invention, taken generally from below and from the side.
Figure 2:
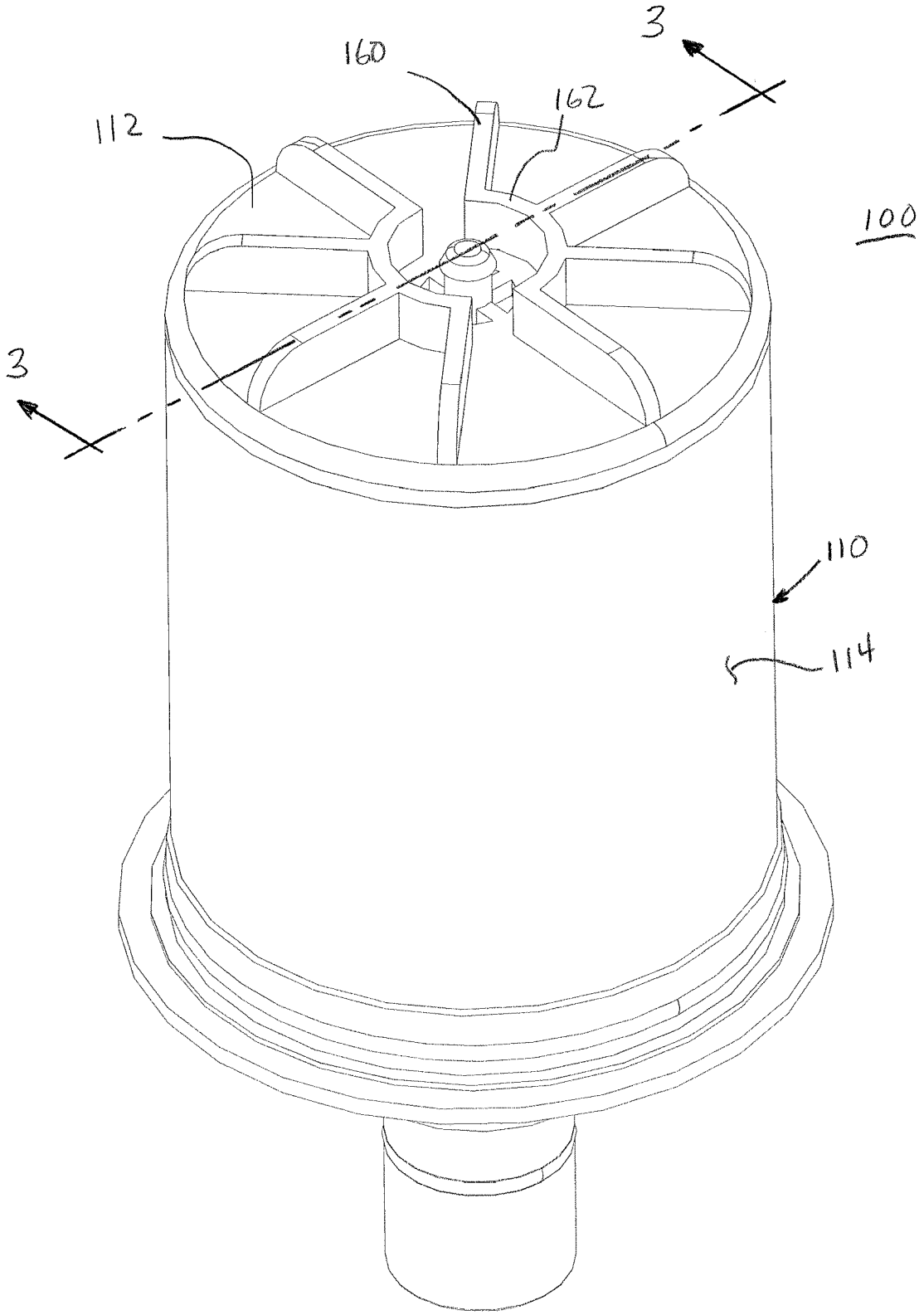
FIG. 2 is an isometric view of the foam pump appearing in FIG. 1, taken generally from above and from the side.

Referring now to the drawings, a FIGS. 1-6 illustrate an exemplary foam pump assembly 100. As used herein, unless specifically stated otherwise, the terms "top," "bottom," "upper," "lower," and other such terms which are dependent on orientation are intended to refer to the orientation of the pump 100 as shown in FIG. 1. The drawings herein depict the foam pump in an orientation wherein the liquid inlet is at located the top and the liquid outlet is located at the bottom. It will be recognized, however, that the presently disclosed pump could also be adapted for use in other orientations. For example, the foam pump assembly 100 could be used in applications wherein it is mounted in the opposite orientation, e.g., in the neck of a rigid dispensing container, such as a counter top or bottle type dispenser, e.g., by employing a dip tube to communicate with the liquid located at the bottom of the container. Likewise, the foam pump assembly herein could be used in a dispenser application wherein the flow axis/direction of piston movement is generally horizontal.

Figure 10:
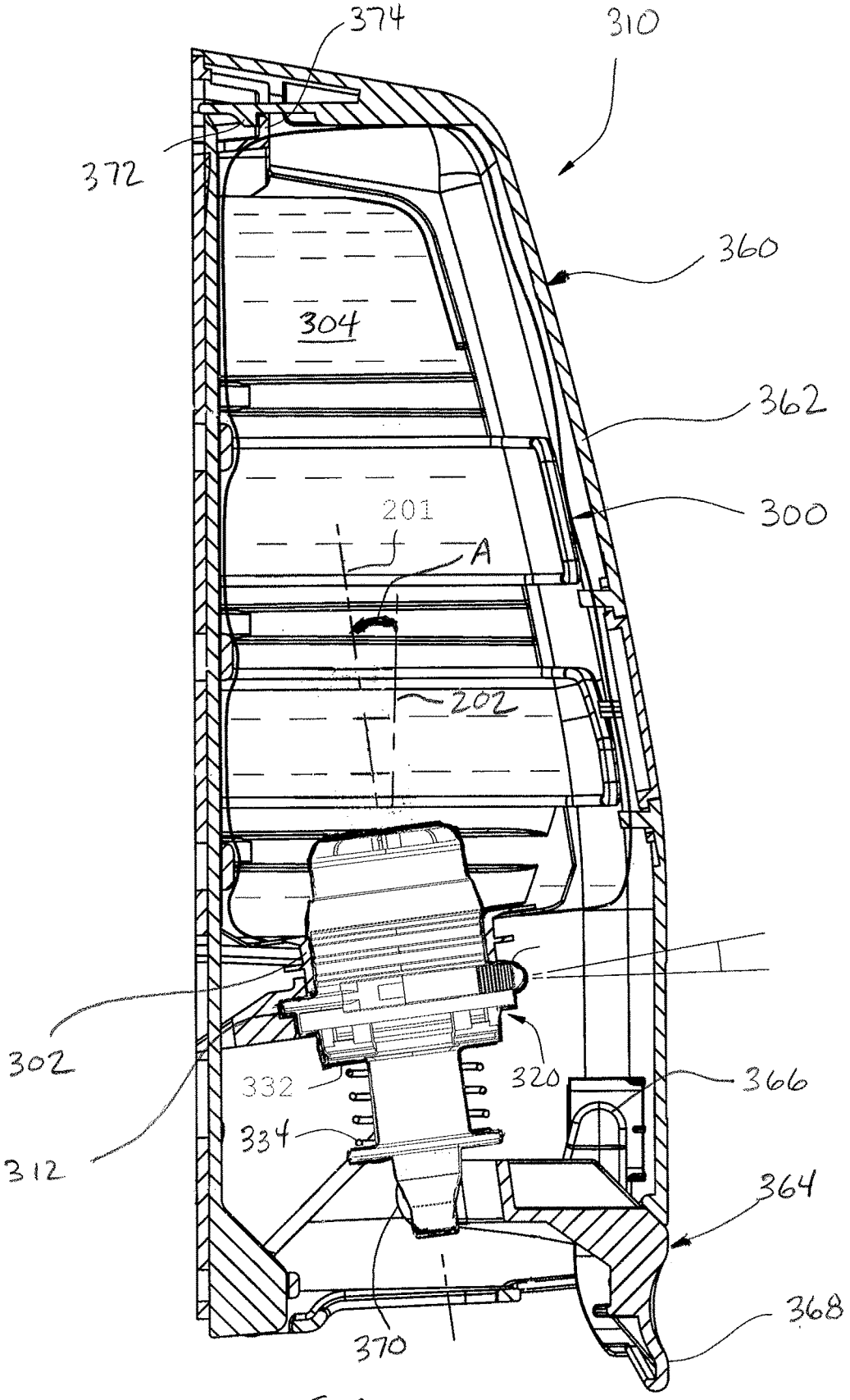
FIG. 10 is a side cross-sectional view showing the foam pump herein within an exemplary dispenser.

In the inverted operational orientation depicted in FIG. 1, the dispensed liquid flows along a generally vertical flow axis 201 (see FIG. 10) such that liquid pump outlet is at a lower vertical position than the liquid pump inlet and the liquid chamber 135 containing the charge of liquid to be dispensed in a subsequent dispensing operation. The term "generally vertical" or "substantially vertical" is not intended preclude deviations of the flow axis from vertical. For example, the pump 100 may be disposed in a dispenser 310 (see FIG. 10) such that the longitudinal axis 201 of the pump 100 is displaced from a vertical axis 202 of the dispenser 310 by an angle A (see FIG. 10). For example, it has been found to be advantageous to configure the dispenser 310 to receive the pump at an angle as seen in FIG. 10, which provides gravitational assistance when installing a pump/bag assembly into the dispenser to ensure that it is properly seated within the dispenser.

The liquids to be dispensed are preferably liquid hygiene products such as hand soaps, facial soaps, shampoos, body soaps, hand sanitizers including waterless hand sanitizers, water-based hand sanitizers, and the like. It will be recognized, however, that other foamable liquids having desirable characteristics when dispensed as a foam are also contemplated, such as hair mousses and foamable hair coloring formulations or compositions, shaving creams, lotions, and the like.

The pump assembly includes a dual air/liquid cylinder 110 having a generally inverted cup-shaped configuration including an upper surface 112 and an annular outer wall 114 extending downward therefrom. The annular outer wall has an inward facing surface 116. The upper surface 112 and the annular outer wall 114 cooperate to define an air chamber or air cylinder 125. The dual cylinder 110 has a lower open end 118 opposite the upper surface 112. An external flange or ridge 120 is disposed at or near the open end 118.

The dual cylinder 110 also includes an inner annular wall 130 extending downward from the upper surface which is concentric with respect to the outer annular wall 114. The inner annular wall 130 has an inward facing surface 132. The inner annular wall 130 defines a liquid cylinder or chamber 135. In the illustrated preferred embodiment, the liquid chamber does not extend beyond the axial extent of the air chamber. Because the liquid chamber does not protrude from the air chamber, a low profile pump can be provided, which is especially advantageous for inverted applications where the container or reservoir containing the liquid is positioned above the pump and it is desirable for the liquid pump inlet to communicate with the liquid located at or near the bottom of the container or reservoir.

A coaxial spring 126, e.g., a coil spring in the illustrated embodiment, is received within the air chamber 125 and surrounds the inner annular wall 130. The upper end of the spring is received within a spring seat defined by the upper surface 112 and an intermediate annular wall 128 coaxially disposed intermediate the inner annular wall 130 and the outer annular wall 114.

An aperture 140 defining a liquid inlet extends through the upper surface 112. A plurality of arms 142 extend radially inwardly into the aperture 140. A liquid inlet valve member 150 includes a shaft portion 152 captured within the aperture 140. The inlet valve 150 is a one-way or non-return valve and includes an enlarged diameter sealing member 154 at a first, lower end of the shaft and an enlarged head portion 156 at a second, upper end of the shaft.

In operation, a dispensing cycle includes a dispensing portion wherein air and liquid are simultaneously forced out of the chambers 125 and 135, respectively, and a fill portion, wherein a foamable liquid from the liquid container or reservoir such as flexible bag 300 (see FIG. 10) is drawn into the chamber 135 and ambient air is drawn into the chamber 125. During the initial, dispensing portion when there is increased pressure within the liquid chamber, the sealing member 154 bears against the upper surface 112 and provides a sealing interference between the inlet valve 150 and the aperture 140 to prevent liquid in the liquid chamber from exiting the chamber and passing back into the liquid container or reservoir 300 through the aperture 140. During the fill portion of a dispensing cycle, responsive to a decrease in pressure in the liquid chamber, the inlet valve 150 moves downward to allow liquid to pass from the bag or reservoir 300 into the liquid chamber by passing around the inlet valve 150 and through the aperture 140. The enlarged head 156 limits the extent of axial movement by the inlet valve 150 within the aperture 140. The inlet valve 150 may be formed of a flexible or resilient material, e.g., an elastomeric or polymeric material. The enlarged head portion 156 may have a tapered or barbed exterior shape that facilitates passage of the enlarged head portion 156 through the aperture 140 during manufacture of the pump assembly while resisting removal of the valve 150 from the opening 140 during operation.

Upstanding features such as radial ribs or and wall members 162 may be formed on the upper surface 112 to protect the valve 150 from interference with the liquid container, such as the flexible bag 300, as it collapses when liquid 304 in the reservoir is withdrawn. By holding the collapsing bag off the liquid inlet, the features 162 allow for continued product evacuation as the bag volume decreases around the pump. The features 162 also improve the structural rigidity of the upper surface 112.

A dual piston assembly 170 is received within the open end 118 of the dual cylinder 110. The dual piston assembly 170 includes an air piston member 172, a liquid piston assembly 174, and a liquid outlet valve 192.

The air piston member 172 includes an upper, open end 178 having a sealing ring 180 attached thereto. The sealing ring 180 is dimensioned to make sliding and sealing contact with the inner surface 116 of the outer wall 114. The liquid piston assembly 174 includes a piston ring 182 received within the liquid chamber 135 and is sized to slidingly and sealingly engage the inner surface 132 of the inner annular wall 130.

The piston ring 182 is mounted on the upper end 184 of the liquid piston assembly 174. The upper portion 184 of the piston assembly 174 defines a hollow shaft or conduit 186. The lower end 188 of the piston assembly 174 defines a valve seat 190 receiving a valve member 192. The valve seat 190 and the valve member 192 cooperate to define a one-way or nonreturn liquid outlet valve. Axial flow channels 191 are formed in the upper portion of the valve member 192 to provide fluid communication between the hollow shaft portion 186 and the valve seat 190.

Figure 3:
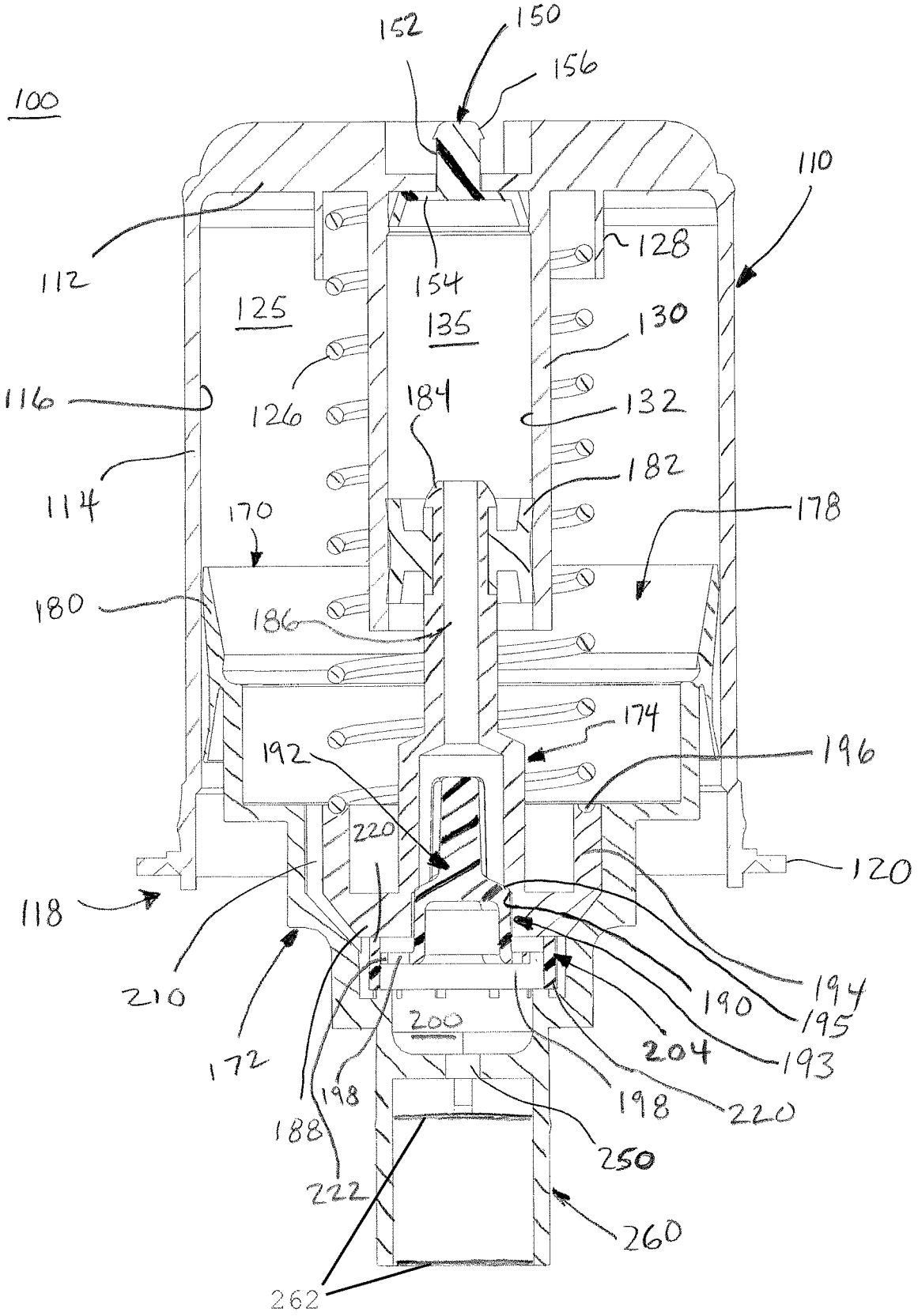
FIG. 3 is a side cross-sectional view taken along the lines 3-3 appearing in FIG. 2.
Figure 4:
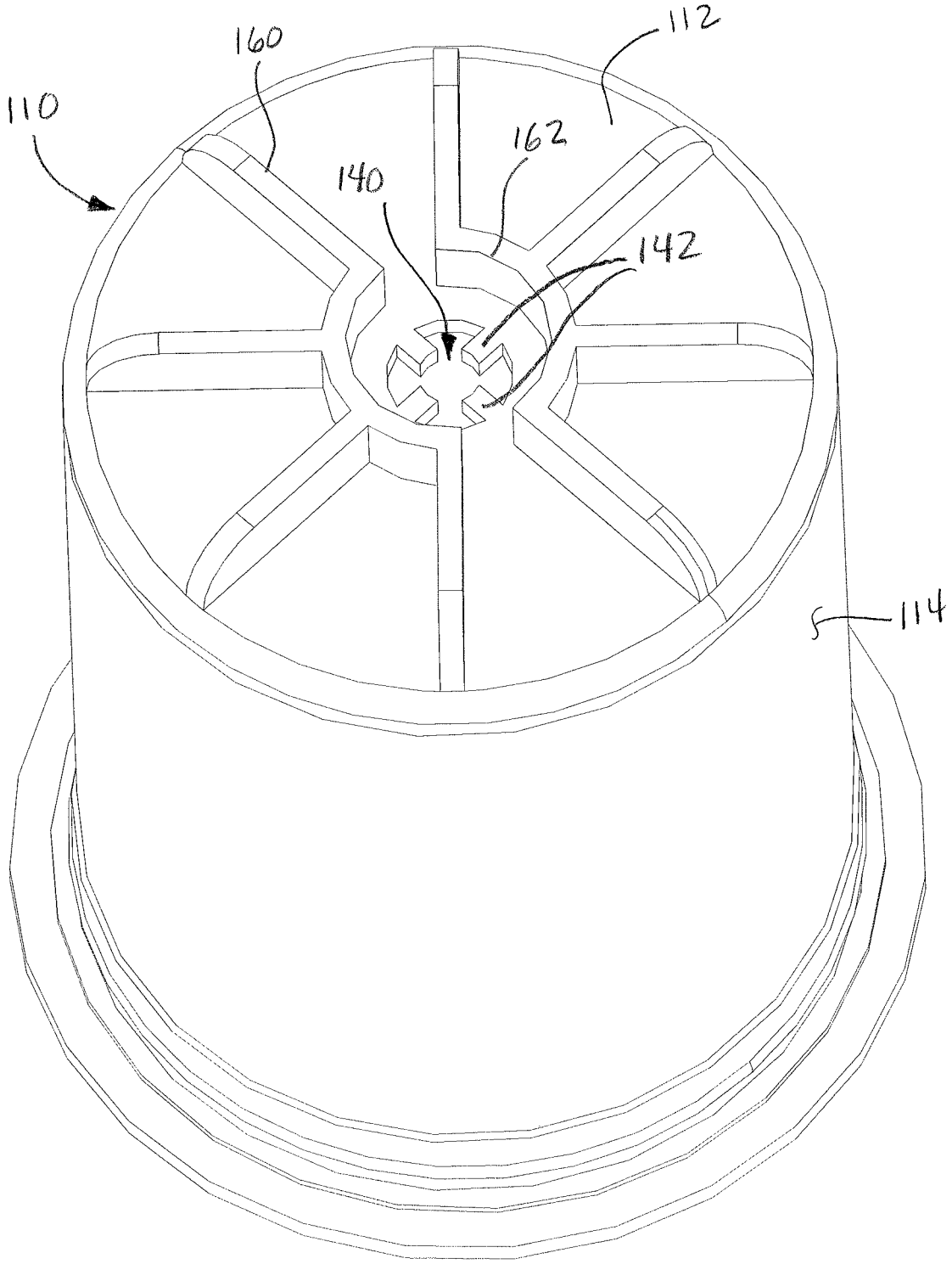
FIG. 4 is an isometric view of the dual cup portion, taken generally from above and from the side.

In the illustrated embodiment, as best seen in FIG. 3, the valve seat 190 is defined by the shoulder portion of a counterbore or countersink region 193 formed in the piston assembly 174. The shoulder portion 193 in the piston assembly 174 cooperates with an enlarged diameter portion 195 on the valve member 192 to define a normally sealed check valve. The liquid outlet valve 192 may be formed of a flexible or resilient material, e.g., an elastomeric or polymeric material. The lower end 188 of the piston assembly 174 also includes an upstanding annular wall 194 defining a spring seat 196 for receiving the lower end of the spring member 126.

During the dispensing portion of a dispensing cycle, when there is increased pressure within the liquid chamber, the flexible and resilient nature of the liquid outlet valve member 192 allows the member 192 to flex such that the portion 195 of the valve member 192 contacting the shoulder portion 193 of the valve seat moves away from the valve seat 190 to allow liquid in the chamber 135 to flow through the conduit 186, around the valve member 192, and through apertures 198 in the valve member 192 and into a mixing chamber 200 defined in the air piston member 172. During the fill portion of a dispensing cycle, responsive to reduction in pressure in the liquid chamber, the resilient nature of the outlet valve member 192 causes the valve member 192 to return to its original shape to provide a sealing engagement between the liquid outlet valve 192 and the valve seat 190.

In the preferred embodiments, the liquid outlet valve member 192 is resiliently biased toward a sealing engagement with the valve seat 190, thereby providing a preselected threshold or cracking pressure necessary to unseat the valve member 192 from the valve seat 190. Once the valve is open, the resilient property of the valve member 192 provides the valve member 192 with a closing force or pressure, which defines a threshold pressure below which the valve will move from the open position to the closed or seated position. In operation, once the pressure in the liquid chamber 135 falls below the threshold closing pressure, the valve member 192 returns to sealing engagement with the valve seat 194.

It has been found that it is possible for the dual cylinder assembly 110 and the dual piston assembly 170 to stick partway through a dispensing operation wherein the dual piston assembly 170 fails to return completely to the non-actuated or home position, e.g., due to stiction/friction between the assemblies 110, 170, the application of off-axial forces to the piston assembly 170, etc. The cracking pressure and/or closing pressure of the valve member 192 is selected such that the valve member will return to sealing engagement with the valve seat 190 to thereby prevent leaking through the liquid outlet valve once the pressure of the liquid in the liquid chamber 135 falls below the valve closing pressure, independently of the position of dual piston assembly 170 in relation to the cylinder assembly 110. That is, because the liquid outlet valve is biased toward the closed or sealed position with a closing pressure, the liquid outlet valve does not require a subsequent volume increase in the liquid chamber following a dispensing operation in order to close, but rather, only requires the outwardly directed flow pressure exerted by the collapsing liquid chamber volume to fall below the closing pressure threshold of the resiliently biased outlet valve.

In alternative embodiments, the resilient valve member 192 and seat 190 may be replaced with an alternative valve structure that is spring biased or otherwise resiliently biased into the closed or seated position and opens when a threshold pressure is created in the liquid chamber (due to collapsing volume of the liquid chamber) and closes when that pressure is removed (e.g., when the liquid chamber halts it volume reduction). For example, in certain embodiments, the illustrated liquid outlet valve can be replaced with a check valve comprising a spring and captured ball type check valve disposed within the flow passageway, wherein the spring urges the ball into sealing engagement with a valve seat as would be understood by persons skilled in the art. The spring constant of the spring may be selected to provide a desired closing pressure. As the liquid chamber is compressed, the liquid moves the ball out of the seated position against the urging of the spring, thereby compressing the spring and allowing the liquid to flow around the ball and into the mixing chamber. When the actuator is released, the spring will cause the ball to return to the seated position and close the liquid outlet valve once the volume in the liquid chamber has stabilized, even if the liquid piston does not return to its original home position.

Figure 5:
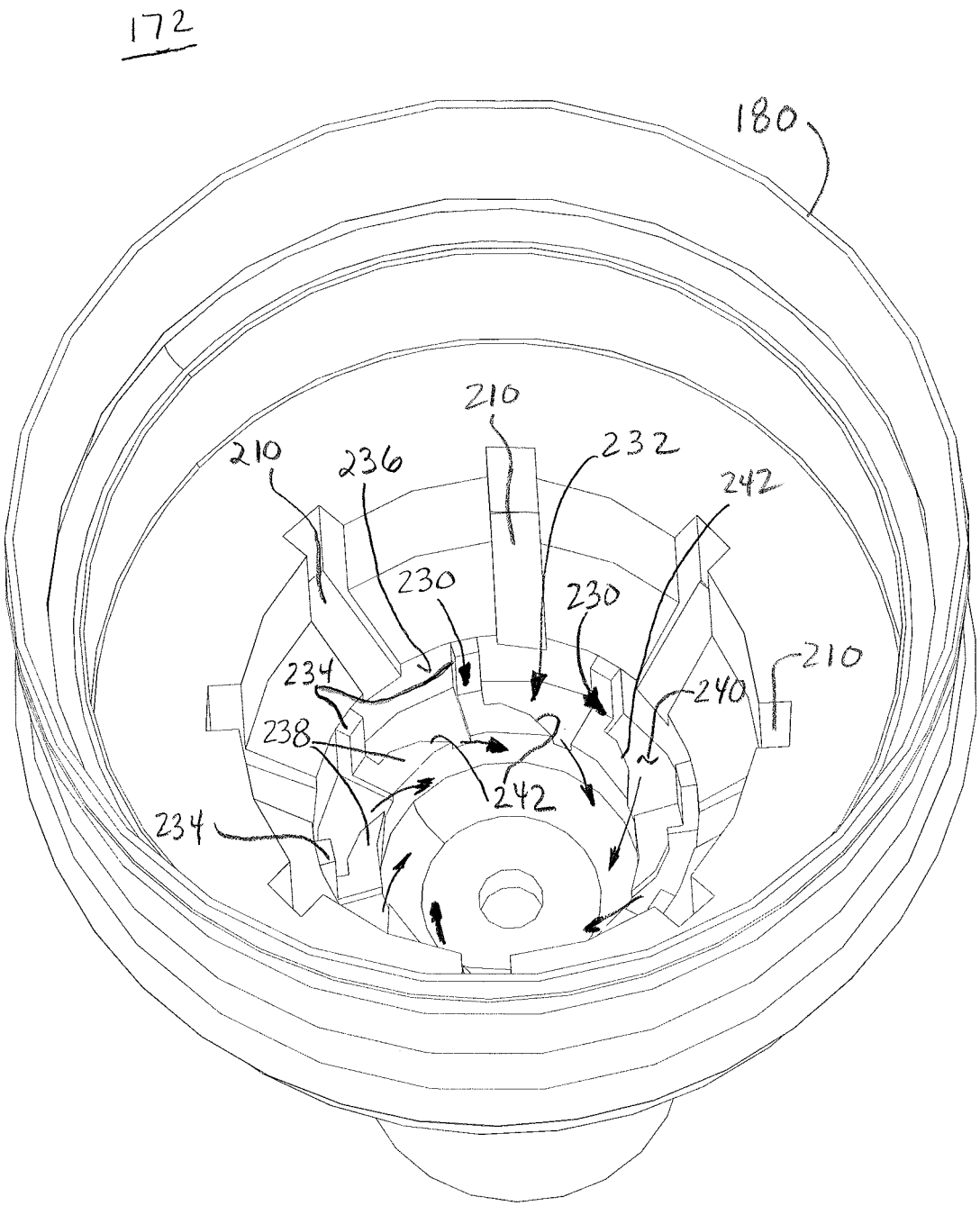
FIG. 5 is an isometric view of the dual cup portion, taken generally from above and from the side.
Figure 6:
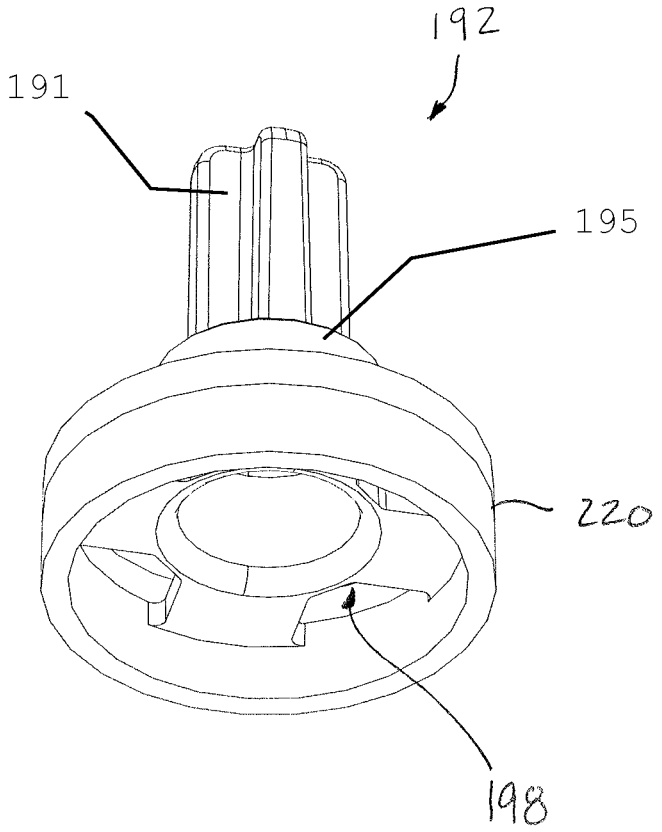
FIG. 6 is an enlarged isometric view of the liquid outlet valve.

During a dispensing cycle, the dispensing portion is initiated by upward movement of the air piston member 172 together with the liquid piston assembly 174, e.g., by manually moving the air piston member 172 and the liquid piston assembly 174 against the urging of the spring 126 using a dispensing lever 364 (see FIG. 10) on the dispenser 310. As best seen in FIG. 5, as the air piston member 172 moves upward, air in the chamber 125 is forced through channels 210 defined in the interior wall of the air piston member 172. A plurality of channels 210 are radially disposed about the center longitudinal axis of the pump 100. The channels 210 are formed adjacent the lower end 188 and upstanding annular wall 194 of the liquid piston assembly 174, which cooperate with the air piston member 172 to define a plurality of air passageways.

The valve member 192 includes a base or foot portion 204 having an annular sealing ring 220 peripherally bounding a flange portion 222 containing the perforations 198. The sealing ring 220 is seated on a plurality of turbulence producing members 230 formed within and circumferentially spaced within a counterbore 232 formed within the air piston member 172. The turbulence-producing members 230 are angularly disposed in between adjacent channels 210. Each of the turbulence producing members 230 includes an internal rib or spline 234 formed on a generally vertical surface 236 of the counterbore 232 and a vane 238 formed on a generally horizontal surface 240 of the counterbore 232.

The upper edge of the sealing ring 220 provides a sealing interference with the lower end 188 of the liquid piston assembly 174 to direct the air from the channels 210 toward the vanes 238. Each of the vanes 238 includes an angled surface 242, which imparts rotational movement to the airflow entering the mixing chamber 200, thereby imparting a vortex flow to the air conducted to the mixing chamber. The vortex airflow in the mixing chamber 200 increases turbulent mixing of the air and liquid in the mixing chamber 200.

The foam in the mixing chamber 200 exits the mixing chamber through an aperture or constriction 250 in the base of the mixing chamber and passes to a foam outlet passageway 260. One or more nets or screens 262 (two in the preferred embodiment) may be provided in the passageway 260 to create a generally uniform air bubble size in the foam.

Figure 7:
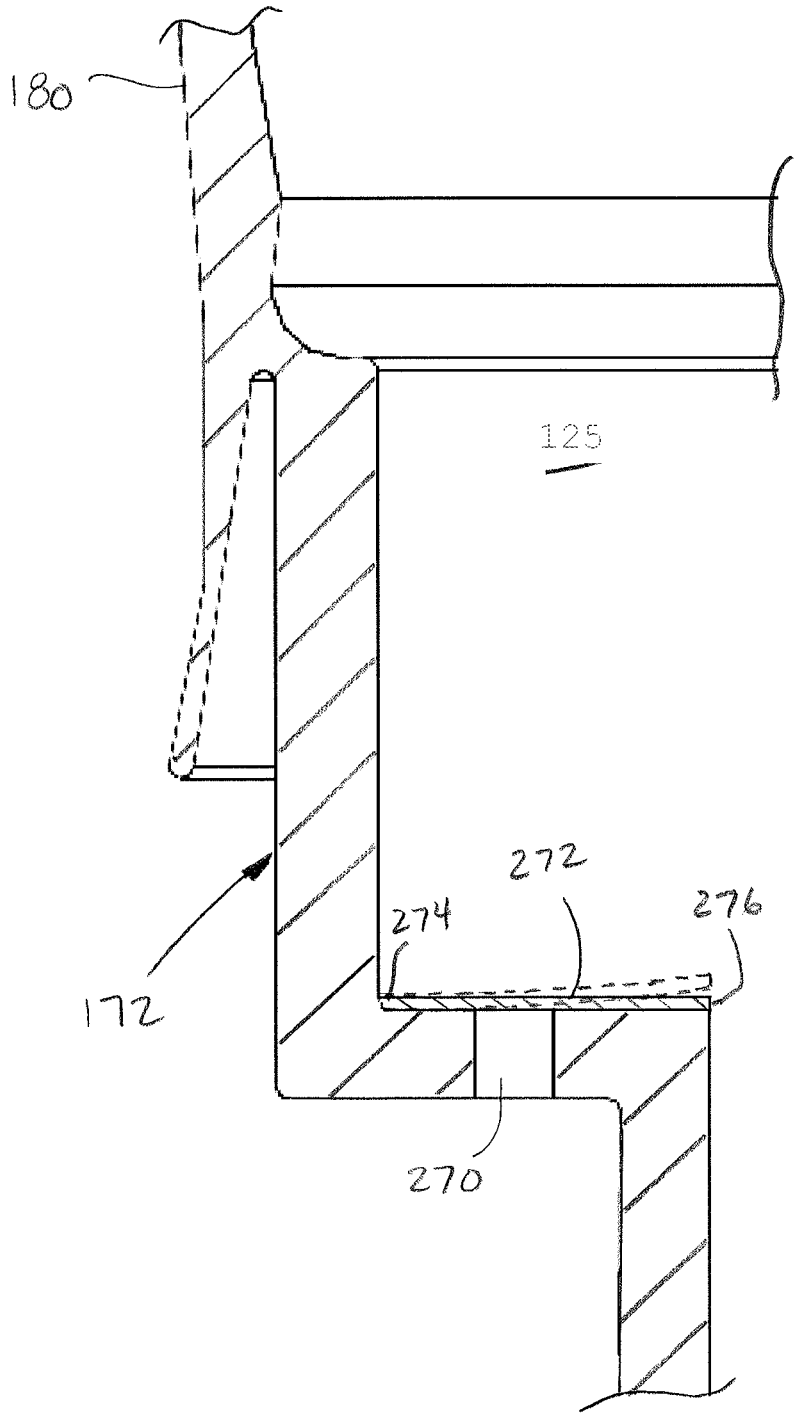
FIG. 7 is fragmentary side cross-sectional view of the air piston member illustrating an exemplary alternative air inlet.

During the fill portion of the dispensing cycle, as the dual piston assembly 170 moves downward at the urging of the spring member 126, liquid enters the chamber 135 via the liquid inlet valve member 150 as detailed above and ambient air enters the air chamber 125 through the mixing chamber 200. Air entering the air chamber 125 passes between the turbulence-producing members 230 and through the channels 210. In alternative embodiments, a separate, one way or return air valve may be provided. An exemplary alternative air piston member having a one-way valve which permits air to enter the chamber 125 during the fill portion of the dispensing cycle is illustrated FIG. 7. In the illustrated alternative embodiment of FIG. 7, one or more air inlets 270 are provided in the air piston member 172. A valve flap 272 covers the opening 270 on the interior surface of the air piston member 172. The valve flap 272 is attached to the interior surface at a proximal end 274 and has a free distal end 276. During the dispensing portion of the dispensing cycle, the increased air pressure in the chamber 125 seals the flap 272 against the opening, thereby closing the air inlet valve. During the fill portion of the dispensing cycle, the distal end 276 of the flap 272 is free to move away from the opening 270 to permit ambient air to enter the chamber 125 through the opening 270.

In certain alternative embodiments (not shown), the air outlet passageways 210 are selectively occluded to air ingress by a one way elastomeric valve/flap placed in the air passageway 210, the counterbore 232, or projecting off the liquid outlet valve 192. Such embodiments may be employed in conjunction with separate, selectively occluded air inlets, such as the occluded inlets 270 as described above and illustrated in FIG. 7. The combined effect of the occluded inlets 270 and the occluded outlets 210 being a separate path for air input to and air output from the air chamber 125.

Figure 8:
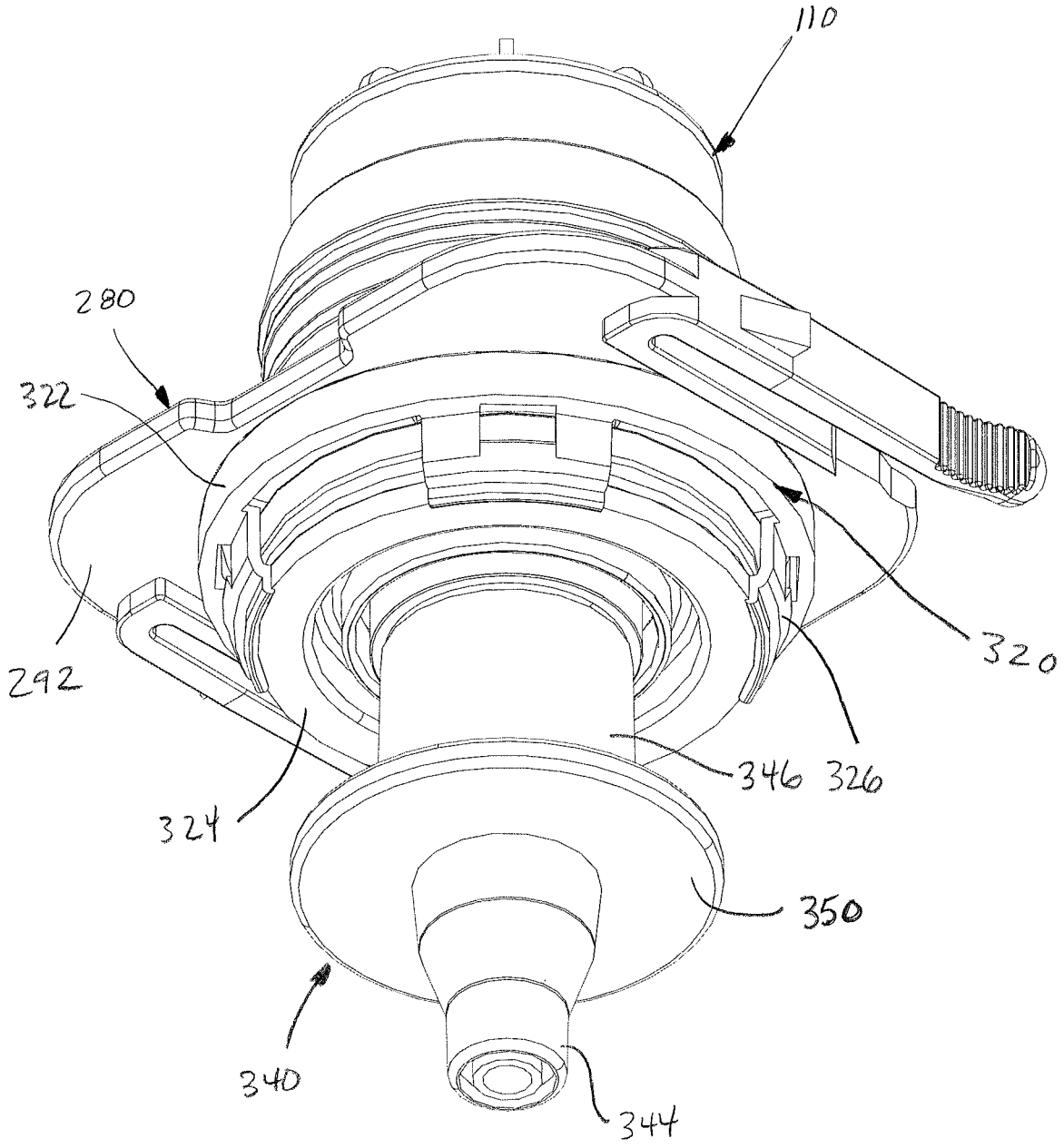
FIG. 8 is an isometric view taken generally from below and from the side illustrating the foam pump embodiment of FIG. 1 having an adapter ring and adapter for mounting the foam pump within a wall-mounted dispenser.
Figure 9:
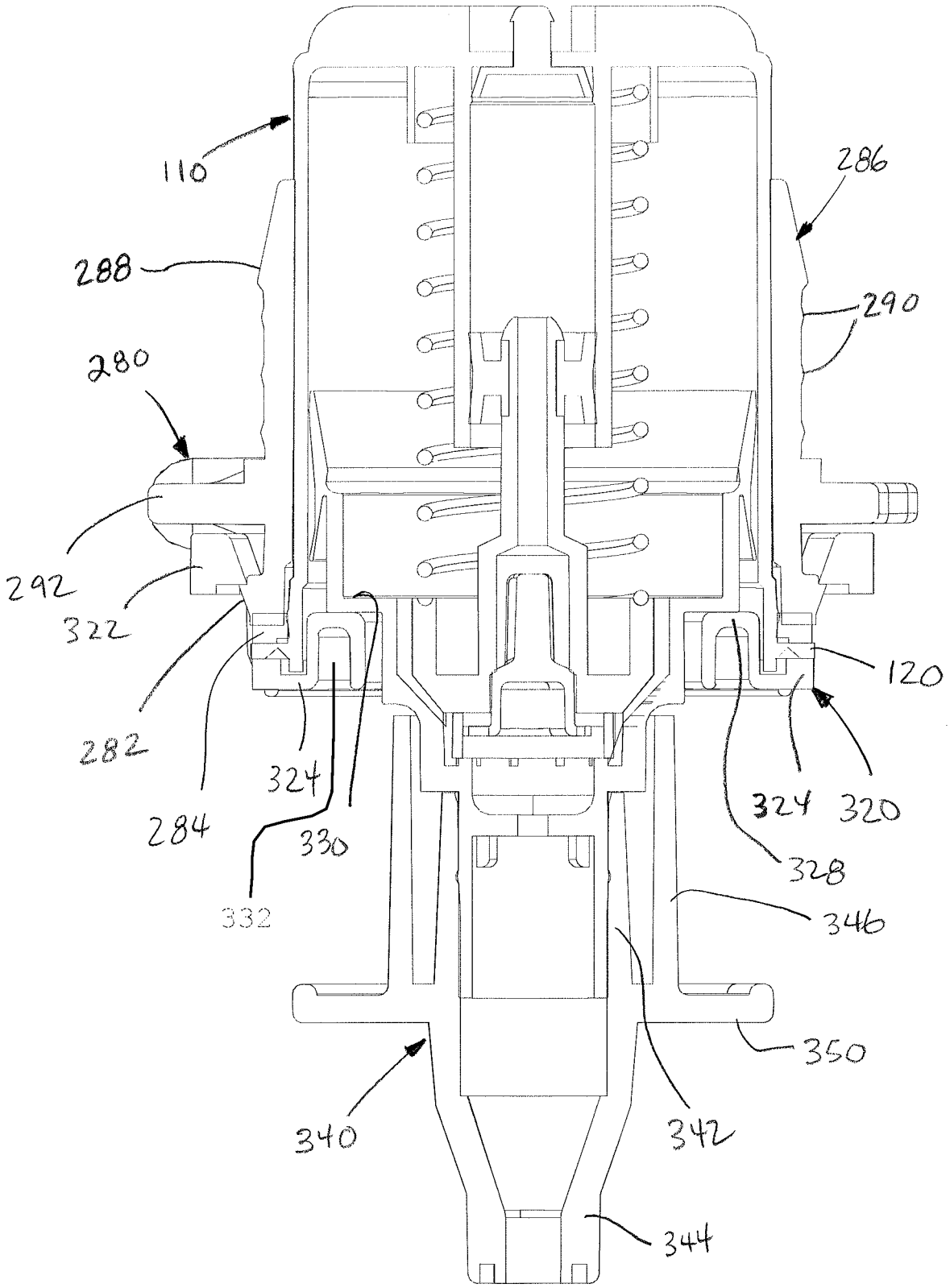
FIG. 9 is a side cross-sectional view of the foam pump with adapter ring and adapter.

Referring now to FIGS. 8-10, an adapter sleeve 280 defines a central opening coaxially receiving the dual cylinder 110. The adapter sleeve 280 includes a lower end 282 engaging a sealing ring 284 such as an O-ring or gasket which in turn engages the flange 120 on the dual cylinder 110. The adapter sleeve 280 includes an upper end 286 configured to be received within a fitment 302 of a flexible bag 300 defining a reservoir containing a foamable liquid 304 which may be of the type suitable for use in a so-called bag-in-box type soap dispenser. The upper end 286 may include a barb 288 and one or more pressure ribs 290 for securing the upper end 286 within the fitment and for providing a fluid tight seal therebetween. The adapter sleeve 280 further includes an intermediate portion 292 intermediate the upper and lower ends and configured to engage a complementary receptacle or nest 312 within the dispenser 310. The dispenser 310 and adapter sleeve 280 may be as shown and described in U.S. Pat. No. 8,336,740, incorporated herein by reference in its entirety.

An adapter ring 320 encircles the lower end 282 of the adapter sleeve 280 and the flange 120 of the dual cylinder 110. The adapter ring 320 includes an upper ring 322 engaging the lower end 282 and a lower ring 324 engaging the flange 120. A plurality of connecting arms 326 attaches the upper ring 322 to the lower ring 324. The lower ring 324 also includes an annular stop 328 which extends radially inward of the open end 118 of the dual cylinder 110 which limits the downward extent of axial movement of the dual piston assembly 170 relative to the dual cylinder 110 and prevents the dual piston assembly 170 from disengaging from the dual cylinder 110. The adapter ring 320 may be as shown and described in U.S. Pat. No. 8,336,740, incorporated herein by reference in its entirety.

In the illustrated embodiment, the air piston member 172 includes a counter bore 330 which defines a shoulder engaging the stop 328. The upper and lower rings 322, 324 are preferably spaced apart in the axial direction by a distance which provides a clamping force on the lower end 282, the sealing ring 284 and the flange 120 to provide secure retention of the foam pump assembly 100 and to prevent leakage of any liquid that may pass between the upper end 286 and the outer wall 114 of the dual cylinder 110. The stop 328 may be configured with an annular groove 332 defining a spring seat for receiving the upper end of an auxiliary spring member 334.

A nozzle 340 includes an inner cylindrical wall 342 receiving the foam passageway 260, which may be secured therein, e.g., via a press fit or snap fit connection. The nozzle 340 also includes a dispensing outlet portion 344 downstream of the inner cylindrical wall 342.

A flange 350 extends radially outwardly at a position on the nozzle 340 intermediate the inner cylindrical wall 342 and the dispensing outlet portion 344. An outer cylindrical wall 346 is coaxial with respect to the inner cylindrical wall 342 and extends upwardly from the flange 350. Optionally, a spring member 334 may be provided around the outer wall 344, with an upper end received within the spring seat 332 and a lower end bearing against the flange 350 to provide an additional downward biasing force to urge the dual piston assembly 170 to the home position. The spring member 334 may be provided in addition to the spring 126 or as an alternative thereto.

The foaming pump assembly 100 may advantageously be used in a dispenser 310 of the type appearing in FIG. 10. The dispenser includes a housing 360 which may include a pivoting front cover 362 for providing easy access to the interior of the dispenser to remove spent pump/bag assemblies and install new pump/bag assemblies. The dispenser 310 may be as shown and described in U.S. Pat. No. 8,336,740, incorporated herein by reference in its entirety.

The dispenser includes a lever 364 pivotally mounted within the dispenser at a pivot point 366. The lever 364 includes a push bar 368, which is manually actuated by the user during operation and a lever arm 370 engaging the lower surface of the flange 350. Inward pressing of the push bar 368 by the user causes upward movement of the dual cylinder assembly 170 corresponding to the dispensing portion of the dispensing cycle. Upon release of the push bar 368, the spring member 126 and/or spring member 334 urge the dual cylinder assembly 170 downward back to the home position, corresponding to the fill portion of the dispensing system, wherein air and liquid are drawn into their respective chambers to await the next dispensing operation. A latch 372 on the pivoting cover 362 releasably engages a catch 374 on the housing 360 to secure the pivoting cover in the closed position.

It will be recognized that the depicted dispenser is exemplary only and that the foaming dispenser pump may be used in connection with all manner of dispensers. Although the present foam pump dispenser is especially advantageous for use in an inverted orientation such as a bag-in-box dispenser wherein the liquid to be dispensed is disposed above the pump because of its low profile and its ability to prevent leaks when used in an inverted orientation, it will be recognized that the foam pump herein may also be adapted for use in noninverted applications such as a countertop container having rigid walls or other container wherein the pump is mounted above the liquid source and wherein a dip tube is used to communicate with the bottom of the container.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A foam pump apparatus comprising:

a. a dual air and liquid cylinder including:
   i. a base wall having a central opening therein defining a liquid inlet;
   ii. an inner annular wall extending from said base wall and surrounding the central opening and having an open end opposite the base wall; and
   iii. an outer annular wall extending from said base wall and surrounding the inner annular wall and having an open end opposite the base wall;

b. a dual air and liquid piston assembly received in said dual air and liquid cylinder, said dual air and liquid piston assembly including:
   i. an air piston member including an air piston ring slidably engaging an inner surface of said outer annular wall, the air piston member cooperating with the outer annular wall to define a collapsible air chamber for receiving air;
   ii. a liquid piston including a liquid piston ring supported on a liquid piston shaft, the liquid piston ring slidably engaging an inner surface of the inner annular wall, the liquid piston cooperating with the inner annular wall to define a collapsible liquid chamber for receiving a foamable liquid, wherein the dual air and liquid piston assembly is movable in relation to the dual air and liquid cylinder along a flow axis;
   iii. the liquid piston shaft having a first end axially adjacent the collapsible liquid chamber, a second end defining a liquid outlet, and a central passageway extending between the first end and the second end, the second end of the liquid piston shaft attached to the air piston member to move therewith;

c. a liquid inlet valve member received within the central opening for regulating flow through the liquid inlet;

d. a liquid outlet valve member disposed at the second end of the liquid piston shaft for regulating flow through the liquid outlet;

e. the dual air and liquid piston assembly including a mixing chamber downstream of the liquid outlet, the mixing chamber in fluid communication with the collapsible liquid chamber through the liquid outlet valve member;

f. the mixing chamber in fluid communication with the collapsible air chamber through a plurality of air passageways, wherein each of the air passageways is configured to cause air entering the mixing chamber to rotate around the flow axis;

g. a biasing member urging said dual air and liquid piston assembly to a non-actuated position, wherein the foam pump is actuatable by urging said dual air and liquid piston assembly against said biasing member to an actuated position in which said collapsible air chamber and said collapsible liquid chamber are reduced in volume such that air is expelled from said collapsible air chamber and through said plurality of air passageways into the mixing chamber while at the same time foamable liquid is expelled from the collapsible liquid chamber through said central passageway with simultaneous movement of the air and the foamable liquid into the mixing chamber causing a turbulent mixing thereof in the mixing chamber;

h. the liquid outlet valve member having a foot portion comprising an annular sealing ring peripherally bounding a perforated flange portion;

i. the sealing ring seated on a plurality of ribs projecting into a counterbore formed within the air piston member; and j. each rib disposed in between adjacent air passageways of said plurality of air passageways.

2. The foam pump apparatus of claim 1, wherein the plurality of air passageways extend between the air piston member and the liquid piston shaft.

3. The foam pump apparatus of claim 1, further comprising an external annular ridge formed on an outer surface of the outer annular wall.

4. The foam pump apparatus of claim 1, wherein the inner annular wall and the outer annular wall are concentric.

5. The foam pump apparatus of claim 1, wherein the liquid chamber has an axial extent which does not extend beyond an axial extent of the air chamber.

6. The foam pump apparatus of claim 1, wherein the biasing member is a coil spring surrounding the inner annular wall, the coil spring having a first end engaging the base wall and a second end opposite the first end, the second end engaging the dual air and liquid piston assembly.

7. The foam pump apparatus of claim 6, further comprising:

an intermediate annular wall surrounding the inner annular wall and cooperating with the inner annular wall and the base wall to define a spring seat receiving the receiving the first end of the coil spring.

8. The foam pump apparatus of claim 1, further comprising a plurality of valve retention arms extending into the central opening for securing the liquid inlet valve member within the central opening, the valve retention arms spaced apart to allow liquid to flow therebetween when the liquid inlet valve member is in an open position.

9. The foam pump apparatus of claim 8, wherein the liquid inlet valve member includes a shaft portion retained between the valve retention arms and an enlarged diameter sealing portion which is selectively moveable into and out of sealing engagement with the base wall.

10. The foam pump apparatus of claim 1, wherein the liquid inlet valve member is configured to close responsive to increased pressurization of the liquid chamber during a dispensing portion of a dispensing cycle and to open responsive to decreased pressurization of the liquid chamber during a fill portion of a dispensing cycle.

11. The foam pump apparatus of claim 1, further comprising a container containing the foamable liquid, the container in fluid communication with the liquid inlet valve member.

12. The foam pump apparatus of claim 1, further comprising one or more protrusions on an exterior surface of the base wall.

13. The foam pump apparatus of claim 1, wherein the liquid outlet valve member is formed of a deformable material which is configured to move away from a complementary valve seat on the liquid piston and thereby open responsive to increased pressurization of the liquid chamber during a dispensing portion of a dispensing cycle.

14. The foam pump apparatus of claim 13, wherein the deformable material is sufficiently resilient to cause the liquid outlet valve member to be self-closing independently of whether the dual air and liquid piston assembly is returned completely to a nonactuated position following a dispensing operation.

15. The foam pump apparatus of claim 13, wherein the liquid outlet valve member has a predetermined cracking pressure below which the liquid outlet valve member will return a sealing engagement with the complementary valve seat.

16. The foam pump apparatus of claim 13, wherein the liquid outlet valve member includes a captured ball biased by a spring to close the liquid outlet, the ball configured to move away from the liquid outlet and thereby open responsive to increased pressurization of the liquid chamber during a dispensing portion of a dispensing cycle.

17. The foam pump apparatus of claim 1, further comprising:

a plurality of vanes disposed between the plurality of air passageways and the mixing chamber, the plurality of vanes being configured to impart rotational flow to air entering the mixing chamber.

18. The foam pump apparatus of claim 17, wherein each rib is formed on a generally vertical surface of the counterbore and each vane is formed on a generally horizontal surface of the counterbore, each of the vanes having an angled surface for imparting rotational movement to the air entering the mixing chamber.

19. The foam pump apparatus of claim 1, further comprising:

the plurality of ribs cooperating with a plurality of vanes to define a plurality of turbulence producing members formed within and circumferentially spaced within the counterbore formed within the air piston member.

20. The foam pump apparatus of claim 1, further comprising:

a foam outlet passageway axially adjacent the mixing chamber, a constriction in a base of the mixing chamber defining an inlet to the foam outlet passageway.

21. The foam pump apparatus of claim 20, further comprising one or more screens disposed in the foam outlet passageway for creating a generally uniform air bubble size in foam exiting the foam outlet passageway.

22. The foam pump apparatus of claim 1, wherein the air passageways are configured to operate as an air inlet for introducing ambient air into the air chamber during a fill portion of a dispensing cycle.

23. The foam pump apparatus of claim 1, further comprising a one way return air valve which selectively opens to allow ambient air to enter the air chamber during a fill portion of a dispensing cycle and closes during a dispensing portion of the dispensing cycle to prevent air within the air chamber from passing therethrough.

24. The foam pump apparatus of claim 23, wherein the one way return air valve comprises a flap valve on the air piston member.

25. The foam pump apparatus of claim 1, further comprising an adapter sleeve defining an opening and coaxially receiving said dual air and liquid cylinder assembly, the adapter sleeve including an upper end configured to be received within a fitment of a container for the foamable liquid.

26. The foam pump apparatus of claim 25, wherein the adapter sleeve further comprises an intermediate portion adjacent the upper end, the intermediate portion configured to engage a complementary receptacle within a dispenser housing.

27. The foam pump apparatus of claim 26, wherein the adapter sleeve further comprises a lower end opposite the upper end, the foam pump apparatus further comprising an annular sealing member disposed between an external flange on the dual air and liquid cylinder and the lower end.

28. The foam pump apparatus of claim 27, further comprising:

an adapter ring assembly encircling the lower end of the adapter sleeve and the external flange of the dual air and liquid cylinder, the adapter ring assembly including an upper ring engaging the lower end and a lower ring engaging the external flange, wherein a plurality of connecting arms on the upper ring attach the upper ring to the lower ring; and an annular stop extending radially and axially inward of the open end of the dual air and liquid cylinder for limiting the extent of axial movement of the dual air and liquid piston assembly to prevent the dual air and liquid piston assembly from disengaging from the dual air and liquid cylinder.

29. The foam pump apparatus of claim 28, further comprising a nozzle attached to the foam outlet passageway.

30. The foam pump apparatus of claim 29, further comprising a nozzle flange on the nozzle extending radially outwardly.

31. The foam pump apparatus of claim 30, further comprising a spring having a first end bearing against the lower ring of the adapter ring assembly and a second end bearing against the nozzle flange.

32. A pump assembly for dispensing a foamable liquid, comprising:

a foam pump, the foam pump comprising:

a. a dual air and liquid cylinder including:

i. a base wall having a central opening therein defining a liquid inlet;

ii. an inner annular wall extending from said base wall and surrounding the central opening and having an open end opposite the base wall; and iii. an outer annular wall extending from said base wall and surrounding the inner annular wall and having an open end opposite the base wall;

b. a dual air and liquid piston assembly received in said dual air and liquid cylinder, said dual air and liquid piston assembly including:

i. an air piston member including an air piston ring slidably engaging an inner surface of said outer annular wall, the air piston member cooperating with the outer annular wall to define a collapsible air chamber for receiving air;

ii. a liquid piston including a liquid piston ring supported on a liquid piston shaft, the liquid piston ring slidably engaging an inner surface of the inner annular wall, the liquid piston cooperating with the inner annular wall to define a collapsible liquid chamber for receiving the foamable liquid, wherein the dual air and liquid piston assembly is movable in relation to the dual air and liquid cylinder along a flow axis;

iii. the liquid piston shaft having a first end axially adjacent the collapsible liquid chamber, a second end defining a liquid outlet, and a central passageway extending between the first end and the second end, the second end of the liquid piston shaft attached to the air piston member to move therewith;

c. a liquid inlet valve member received within the central opening for regulating flow through the liquid inlet;

d. a liquid outlet valve member disposed at the second end of the liquid piston shaft for regulating flow through the liquid outlet;

e. the dual air and liquid piston assembly including a mixing chamber downstream of the liquid outlet, the mixing chamber in fluid communication with the collapsible liquid chamber through the liquid outlet valve member;

f. the mixing chamber in fluid communication with the collapsible air chamber through a plurality of air passageways wherein each of the air passageways is configured to cause air entering the mixing chamber to rotate around the flow axis;

g. a biasing member urging said dual air and liquid piston assembly to a non-actuated position, wherein the foam pump is actuatable by urging said dual air and liquid piston assembly against said biasing member to an actuated position in which said collapsible air chamber and said collapsible liquid chamber are reduced in volume such that air is expelled from said collapsible air chamber and through said plurality of air passageways into the mixing chamber while at the same time foamable liquid is expelled from the collapsible liquid chamber through said central passageway with simultaneous movement of the air and the foamable liquid into the mixing chamber causing a turbulent mixing thereof in the mixing chamber;

h. the liquid outlet valve member having a foot portion comprising an annular sealing ring peripherally bounding a perforated flange portion;

i. the sealing ring seated on a plurality of ribs projecting into a counterbore formed within the air piston member; and j. each rib disposed in between adjacent air passageways of said plurality of air passageways; and a container containing the foamable liquid, the container having an opening in fluid communication with the liquid inlet.

33. The pump assembly of claim 32, wherein the foamable liquid is selected from the group consisting of a soap, a shampoo, a hand sanitizer, a hair mousse, a hair coloring composition, a shaving cream, and a lotion.

34. An apparatus for dispensing a foamable liquid, comprising:

a housing defining a housing interior;

an actuator movably mounted on said housing;

a foam pump received within the housing interior, the foam pump comprising:

a. a dual air and liquid cylinder including:

i. a base wall having a central opening therein defining a liquid inlet;

ii. an inner annular wall extending from said base wall and surrounding the central opening and having an open end opposite the base wall; and iii. an outer annular wall extending from said base wall and surrounding the inner annular wall and having an open end opposite the base wall;

b. a dual air and liquid piston assembly received in said dual air and liquid cylinder, said dual air and liquid piston assembly including:

i. an air piston member including an air piston ring slidably engaging an inner surface of said outer annular wall, the air piston member cooperating with the outer annular wall to define a collapsible air chamber for receiving air;

ii. a liquid piston including a liquid piston ring supported on a liquid piston shaft, the liquid piston ring slidably engaging an inner surface of the inner annular wall, the liquid piston cooperating with the inner annular wall to define a collapsible liquid chamber for receiving the foamable liquid, wherein the dual air and liquid piston assembly is movable in relation to the dual air and liquid cylinder along a flow axis;

iii. the liquid piston shaft having a first end axially adjacent the collapsible liquid chamber, a second end defining a liquid outlet, and a central passageway extending between the first end and the second end, the second end of the liquid piston shaft attached to the air piston member to move therewith;

c. a liquid inlet valve member received within the central opening for regulating flow through the liquid inlet;

d. a liquid outlet valve member disposed at the second end of the liquid piston shaft for regulating flow through the liquid outlet;

e. the dual air and liquid piston assembly including a mixing chamber downstream of the liquid outlet, the mixing chamber in fluid communication with the collapsible liquid chamber through the liquid outlet valve member;

f. the mixing chamber in fluid communication with the collapsible air chamber through a plurality of air passageways wherein each of the air passageways is configured to cause air entering the mixing chamber to rotate around the flow axis;

g. a biasing member urging said dual air and liquid piston assembly to a non-actuated position, wherein the foam pump is actuatable by urging said dual air and liquid piston assembly against said biasing member to an actuated position in which said collapsible air chamber and said collapsible liquid chamber are reduced in volume such that air is expelled from said collapsible air chamber and through said plurality of air passageways into the mixing chamber while at the same time foamable liquid is expelled from the collapsible liquid chamber through said central passageway with simultaneous movement of the air and the foamable liquid into the mixing chamber causing a turbulent mixing thereof in the mixing chamber;

h. the liquid outlet valve member having a foot portion comprising an annular sealing ring peripherally bounding a perforated flange portion;

i. the sealing ring seated on a plurality of ribs projecting into a counterbore formed within the air piston member; and j. each rib disposed in between adjacent air passageways of said plurality of air passageways;

a container containing the foamable liquid received within the housing interior, the foamable liquid in fluid communication with the liquid inlet;

the actuator in mechanical communication with the dual air and liquid piston assembly and cooperable therewith to dispense the foamable liquid from the container to a location exterior of the housing responsive to movement of the actuator means relative to the housing.

* * * * *